US005478166A

United States Patent [19]

Starr

[11] Patent Number: 5,478,166

[45] Date of Patent: Dec. 26, 1995

[54] BOAT LIFT

[76] Inventor: James R. Starr, 388 E. Bell Rd., Camden, Mich. 49232

[21] Appl. No.: 194,308

[22] Filed: Feb. 10, 1994

[51] Int. Cl.[6] ..... B63C 3/00

[52] U.S. Cl. ..... 405/3; 405/219

[58] Field of Search ..... 405/1, 3, 4, 219, 405/221; 114/44, 45

[56] References Cited

U.S. PATENT DOCUMENTS

| | | | |
|---|---|---|---|
| 2,918,030 | 12/1959 | Bagnall . | |
| 3,005,214 | 10/1961 | Fruendt . | |
| 3,626,447 | 12/1971 | Hindkin . | |
| 3,710,409 | 6/1973 | Davidson . | |
| 3,797,435 | 3/1974 | Dunson . | |
| 4,750,444 | 6/1988 | Lemvig . | |
| 4,817,555 | 4/1989 | Meinen . | |
| 4,887,541 | 12/1990 | Rodemann . | |
| 5,016,551 | 5/1991 | Peck et al. | 405/3 X |
| 5,094,181 | 3/1992 | Fuerst . | |
| 5,131,784 | 7/1992 | Maasen | 405/3 X |

*Primary Examiner*—David H. Corbin
*Attorney, Agent, or Firm*—Lundy and Associates

[57] ABSTRACT

A boat lift having opposite sides with a pair of air bladders secured to the sides, respectively. An air bladder enclosure surrounding each air bladder. The enclosures defining the size and shape of the bladders when the bladders are inflated. The lift is more buoyant when the bladders are inflated whereby the lift may be floated to and from position and sunk as desired.

20 Claims, 1 Drawing Sheet

BOAT LIFT

BACKGROUND OF THE INVENTION

The present invention relates to boat lifts, and more particularly to boat lifts which each year need to be placed in position in the spring and removed from the water in the fall.

Heretofore, boat lifts in a great variety of styles have been proposed for use adjacent the shore to lift boats out of the water when not in use. A boat lifted out of the water does not need to be tethered, nor is subject to wave motion, nor is subject to bottom discoloration or the like, and thus, such boat lifts have proven to be very popular.

Such boat lifts have been provided with a carriage that vertically lifts the boat upwardly within a frame, a carriage that pivots on a frame, or an angular skid upon which the boat may be slid upwardly. Boat lifts of these types may weigh from a few hundred pounds to a few thousands of pounds. Great weight reduction was achieved relatively recently when such boat lifts were made of aluminum rather than steel.

All of these boat lifts pose the same problem each year to the user in the northern parts of the country where the water freezes. That is, each spring, the boat lift must be placed within the water and positioned as desired and each fall the boat lift must be removed from the water and stored during the winter months.

A great variety of methods have been used to place boat lifts in the water and to remove boat lifts from the water. These include using a variety of watercraft including rowboats, canoes, and pontoon boats beneath the boat lift to float the boat lift into position and to sink the boat lift into position as desired. Some boat lifts even have the capability of utilizing the same winch system that lifts the boat to lift the boat lift onto such watercraft once the watercraft is positioned beneath the boat lift. Thus, the owner of the boat lift must have at his or her disposal suitable watercraft for this purpose.

It is therefore highly desirable to provide an improved boat lift.

It is also highly desirable to provide an improved boat lift which can be more easily positioned in the water in the spring as desired and removed from the water in the fall.

It is also highly desirable to provide an improved boat lift by which placement of the boat lift in the water in the spring and the removal of the boat lift from the water in the fall can be achieved without utilizing additional watercraft or an assemblage of persons.

While it has been herebefore proposed to secure hollow drums onto a boat lift for flotation purposes, such drums have not been widely used for a variety of reasons. Firstly, the drums have to be removed from the boat lift in order to sink the boat lift when positioned in a desired position. Thus, the use of drums is not any more convenient than the use of the auxiliary watercraft as aforedescribed, and may be more dangerous. Secondly, the drums cannot be permanently affixed to the boat lift as the drums can never be made sufficiently less buoyant to sink the boat lift. Thus, they must be attached when desired and removed from the boat lift when the boat lift is in position. Thirdly, it is relatively expensive to provide such drums which will not leak in any condition. When such drums leak and are filled with water, the drums become very difficult to manage, and if attached to the boat lift, add weight to the boat lift rather than to add buoyancy to the boat lift. Fourthly, the use of removable drums, especially with the heavier boat lifts, have proven to be extremely dangerous. Thus, the use flotation drums has not been widespread, and abandoned by most.

It is therefore highly desirable to provide an improved boat lift which can be made buoyant as with attached drums, but does not have any of the disadvantages of drums.

It is also highly desirable to provide an improved boat lift with selective buoyancy which may be permanently secured to the boat lift.

It is finally highly desirable to provide an improved boat lift with all of the above mentioned features.

SUMMARY OF THE INVENTION

It is therefore an object of the invention to provide an improved boat lift.

It is also an object of the invention to provide an improved boat lift which can be more easily positioned in the water in the spring as desired and removed from the water in the fall.

It is also an object of the invention to provide an improved boat lift by which placement of the boat lift in the water in the spring and the removal of the boat lift from the water in the fall can be achieved without utilizing additional watercraft or an assemblage of persons.

It is also an object of the invention to provide an improved boat lift which can be made buoyant as with attached drums, but does not have any of the disadvantages of drums.

It is also an object of the invention to provide an improved boat lift with selective buoyancy which may be permanently secured to the boat lift.

It is finally an object of the invention to provide an improved boat lift with all of the above mentioned objects.

In the broader aspects of the invention, there is provided a boat lift having opposite sides with a pair of air bladders secured to the sides, respectively. An air bladder enclosure surrounding each air bladder. The enclosures defining the size and shape of the bladders when the bladders are inflated. The lift is more buoyant when the bladders are inflated whereby the lift may be floated to and from position and sunk as desired.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A PREFERRED EMBODIMENT

Figure 2:
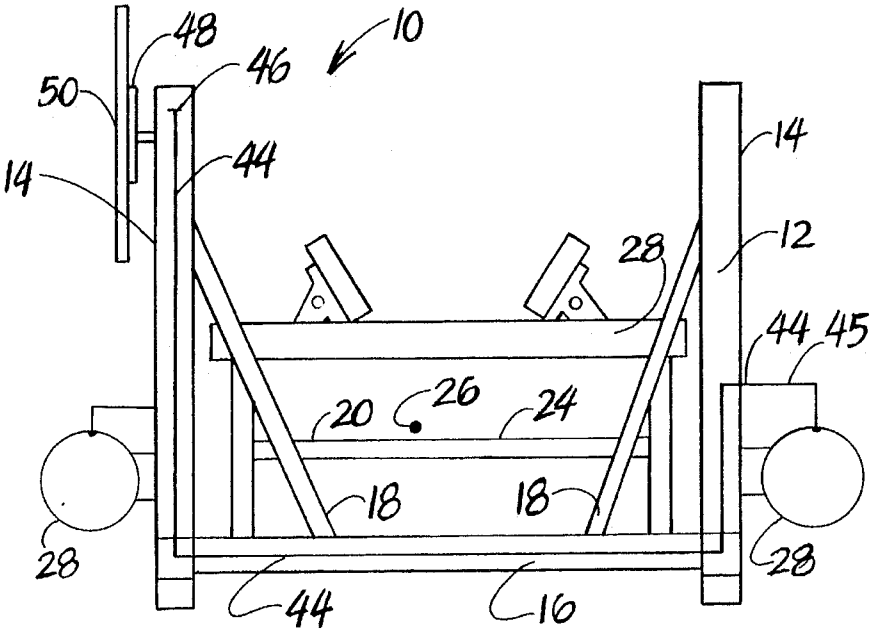
FIG. 2 is a side, plan view of the boat lift illustrated in FIG. 1 taken in a direction generally 90° from the direction of FIG. 1.
Figure 1:
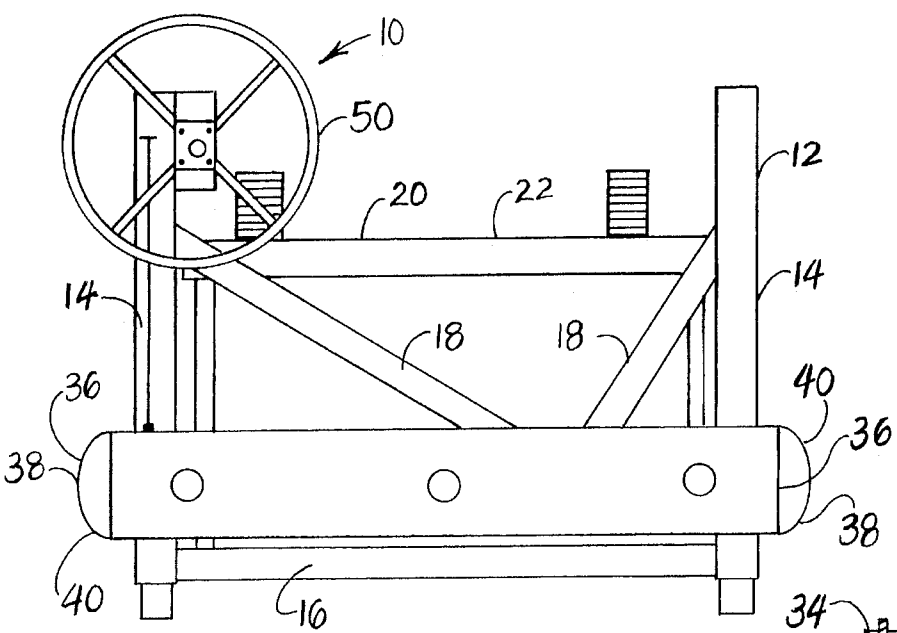
FIG. 1 is a side, plan view of an improved boat lift of the invention.

Referring to FIGS. 1 and 2, there is shown the improved boat lift 10 of the invention to include a base frame 12 having four upright corner posts 14 interconnected by base members 16 and angular braces 18. Upright 14 and horizontal base member 16 and braces 18 provide a rigid base frame 12 in which is positioned a movable cradle 20. Cradle 20 is guided by uprights 14 for movement between a high position 22 (shown in FIG. 1) and a low position 24 (shown in FIG. 2). Traditionally, cradle 20 is guided by a series of rollers affixed to the cradle 20 which roll on the exterior surfaces of uprights 14: however, any guiding system previously used will suffice for the boat lift 10 of the invention.

A cable and pulley system is utilized for moving the cradle 20 from its lower position 24 to its higher position 22 which is not shown. The pulley system traditionally has pulleys affixed to the upper portions of uprights 14 and to the cradle 20 and a cable extends from one of the uprights 14 through the pulleys and to a winch 48 having a large wheel 50 to provide the mechanical advantage by which the boat cradle 20 with or without a boat on it is winched between its lower position 24 and its higher position 22. Boat winches are conventionally provided with a ratchet and pawl mechanism by which the weight of the boat will not move the winch in a manner unintended.

The boat lift 10 of the invention may be provided with members 16 of the same length such that the base frame 12 of the boat lift 10 in generally horizontal cross sections is generally square in shape. Other boat lifts 10 in accordance with the invention may have similar cross sections which are generally rectangular in shape. In order to include both such boat lifts, the two pair of opposite sides of the boat lifts 10 having a square cross section and the opposite ends and the opposite sides of the boat lifts 10 having a rectangular cross sections-both will be referred to herein as "opposite sides".

In all of the boat lifts of the type to which this invention pertains, the center gravity 26 is relatively low. Because of the uprights 14 being widely spaced apart, the center of gravity 26 is usually no higher than about 3 feet above the base member 16.

Figure 3:
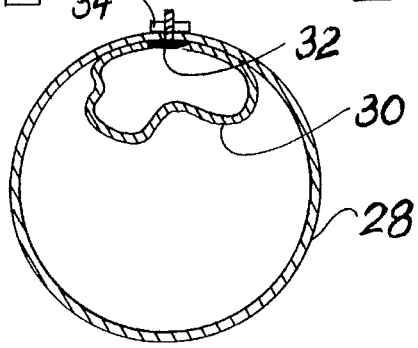
FIG. 3 is an enlarged cross-sectional view of the air bladder enclosure and the air bladder of the invention.

Secured to the opposite sides of the boat lift 10 are a pair of air bladder enclosures 28. Within each air bladder enclosure 28 is an air bladder 30. Each air bladder 30 has a conventional valve stem 32 as found in automobile or bicycle inner tubes. In a specific embodiment, air bladders 30 are connected to the air bladder enclosure 28 by means of a nut 34 which is positioned on the valve stem 32 and the valve stem 32 is inserted in a hole in the air bladder enclosure 28 between the nut 34 and the air bladder 30 as shown in FIG. 3. In a specific embodiment, the air bladder 30 may be constructed like an elongated inner tube construction which has the shape of a sausage with the valve stem position in between the opposite ends. In a specific embodiment, air bladder 30 has a diameter ranging from about 8 inches to about 14 inches, and a length which ranges from about 8 feet to about 12 feet. By providing air bladders 30 in various diameters and lengths, proper buoyancy can be provided for boat lifts ranging in weight from about 200 pounds to about 1,400 pounds.

Air bladder enclosures 28 are shown to be provided as elongated tubes extending generally the entire length of the opposite sides of the boat lift 10. In specific embodiments, the air bladder enclosures 28 may be affixed to any of the opposite sides as desired, or in the case of boat lifts having a rectangular horizontal cross section to the opposite ends of the boat lift 10. Air bladder enclosures 28 may be provided with either a circular cross section as shown in FIGS. 1 and 2, or cross sections of other geometric shapes, including square, rectangular, hexagonal, parabolic and elliptical shapes. The cross sectional shape of the air bladder enclosures 28 do not relate to function as the air bladder 30 therein will conform to the shape the air bladder enclosure 28. In specific embodiments, boat lifts 10 of a variety of weights can be provided with sufficient buoyancy using identical air bladders 30 and enclosures 28 of the same length, but of different diameters, or of the same diameters but with different lengths, thereby significantly reducing the cost of manufacture.

In a specific embodiment, air bladder enclosure 28 is provided with open ends 36 and is perforated at various positions along its axial length to provide for drainage. The open ended air bladder enclosures 28 may have rounded end caps 40 as shown in FIG. 1 when the enclosures extend beyond the base frame 12 to provide a suitable bumper surface 38. In other specific embodiments, air bladder enclosure 28 is shorter than the base frame 12 such that the base frame 12 provides protection to the air bladder enclosure 28 at its opposite ends and end caps 40 are not required. In still other specific embodiments, enclosures 28 are longer than the air bladders 30 when inflated such that end caps 40 are not needed to protect the bladders 30.

In all embodiments, air bladder enclosures 28 are provided with drainage holes at its lowest positions such that the air bladder enclosures 28 will totally drain of water when the boat lift 10 is out of the water. Any water retained in the air bladder enclosures 28 is not preferred as the water adds weight to the boat lift and reduces the volume of the enclosures 28 and one of the objects of the boat lift 10 of the invention is to provide the maximum buoyancy when the boat lift 10 is in water without adding appreciable weight to the boat lift 10, and when the boat lift 10 is out of the water.

In a specific embodiment, air bladder enclosures 28 may be lengths of perforated irrigation pipe of suitable diameter secured to the outside of the corner posts 14 as shown in FIGS. 1 and 2. In another specific embodiment, end caps 40 may be provided air bladder enclosures 28 at the opposite ends 36 to give the opposite ends 36 a rounded, spherical shape. In none of the embodiments are air bladder enclosures 28 a pressurized vessel as the air bladder enclosures 28 are always provided with sufficient drainage holes not only to drain the enclosure, but to relieve any air pressure therein.

Air bladder enclosures 28, in all embodiments, are secured to the base frame 12 of the boat lift 10 within about 3 feet of the center of gravity 26 of the boat lift 10 or below. This feature provides that the lift 10 is stable and cannot be easily be tipped on its side when fully supported on the ground or floating in the water and will draw a minimum of water when floating. In all embodiments, the volume of the air bladder enclosures 28 is from about 4 cubic feet to about 30 cubic feet depending upon the size and weight of the lift 10.

The air bladders 30 are connected together by an air line 44. In a specific embodiment, air line 44 is connected to a single air valve 46. In this manner, air bladders 30 are inflated or deflated together whereby the boat lift 10 will have a relatively even buoyancy side to side, and the boat lift 10 will float in a generally horizontal position. Alternatively, each of the air bladders 30 can be provided with its own air valve 46 and inflated separately. In still other specific embodiments, air valves 46 are shown in lines 44 adjacent to each air bladder 30 and allow for the uneven inflation of air bladders 30 as desired.

In operation, the improved boat lift 10 of the invention functions to lift boats out of the water for storage when not in use in the same manner as conventional boat lifts. Boat lifts 10, however, can be placed in the water in a desired position in the spring and removed from the water in the fall more easily. In order to place the boat lift 10 into position, the boat lift 10 is placed in the water and an air pump is connected to air valve 46 and the air bladders 30 are inflated. With the air bladders 30 connected within the enclosures 28, the air bladders 30 will inflate relatively evenly within the enclosures 28, and the boat lift 10 will become more buoyant relatively evenly from side to side. With boat lifts having a total weight of less than about 1,400 pounds, the boat lift 10 becomes buoyant and may be floated to its desired position. With boat lifts 10 having a total weight of more than about 1,400 pounds, the lift 10 still becomes more buoyant but may have to be carried to its desired position. When in its desired position, the air valve 46 may be opened and the air bladders 30 deflated so as to sink the boat lift 10 in position. This can be done gradually, such that the boat lift 10 may be held by one or two persons and placed in the exact position as desired.

Removal of the boat lift 10 from the water in the fall is similarly simple. The air bladders 30 are inflated and the boat lift 10 is made buoyant. The boat lift 10 is floated or carried toward the shore and placed upon the shore as desired. Inasmuch as the boat lifted easily while still in the water, it is possible to place beneath the boat lift 10 trailers, dollies or the like while the lift is still in the water such that the boat lift 10 may be rolled up on the shore and placed where desired for winter storage.

The improved boat lift 10 of the invention provides a boat lift which can be placed in the water in the spring and removed from the water in the fall more easily and without the use of additional watercraft. The improved boat lift 10 of the invention provides this feature by structure permanently affixed to the boat lift and in a manner whereby only minimal extra cost is added to the boat lift. No pressure vessels are required, the structure is relatively simple with all parts that may wear out easily replaceable.

While a specific embodiment of the invention bas been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A boat lift having a ground supported base frame, said frame having opposite sides, a pair of air bladder enclosures secured to said sides, respectively, an air bladder within each of said enclosures, said bladder enclosures surrounding said air bladders, said enclosures defining the size and shape of said bladders when said bladders are inflated, said lift being more buoyant when said bladders are inflated than when said bladders are not inflated, said lift being totally ground supported when said bladders are not inflated, whereby said lift may be moved to and from position and sunk as desired being and deflating said bladders, respectively.

2. The lift of claim 1 wherein said bladders are operatively connected to a common valve whereby both bladders can be inflated or deflated together.

3. The lift of claim 1 wherein said enclosures are tubular.

4. The lift of claim 3 wherein said tubes each have two end closures, said tubes being rigid and longer than said bladders when inflated.

5. The lift of claim 1 wherein said enclosures are perforated.

6. The lift of claim 3 wherein said enclosures are pipe.

7. The lift of claim 3 wherein said tubes are circular in cross section and perforated.

8. The lift of claim 1 wherein said lift is rectangular and said sides include opposite ends and sides, and said bladder enclosures are secured to said opposite ends of said lift.

9. The lift of claim 1 wherein said lift is rectangular and said sides include opposite ends and sides, and said bladder enclosures are secured to said opposite sides of said lift.

10. The lift of claim 1 wherein said bladders are secured to said lift at a vertical height below about three feet above the center of gravity of said lift.

11. The lift of claim 1 wherein said enclosures are elongated and extend essentially the entire length of said opposite sides.

12. The lift of claim 1 wherein said enclosures have a volume from about 4 to about 30 cubic feet.

13. The lift of claim 1 wherein said enclosures have a volume less than about 20 cubic feet.

14. The lift of claim 1 wherein said lift is not buoyant when said bladders are inflated.

15. The lift of claim 1 wherein said lift is buoyant when said bladders are inflated.

16. The lift of claim 1 wherein said enclosures are tubular, said enclosures are perforated, said bladders are secured to said lift at a vertical height below the center of gravity of said lift, said enclosures are elongated and extend essentially the entire length of said opposite sides.

17. The lift of claim 16 wherein said enclosures have a volume less than about 30 cubic feet.

18. The lift of claim 1 wherein said enclosures are tubular, said enclosures are perforated, said enclosures are secured to said lift at a vertical height below the center of gravity of said lift, said enclosures are elongated and extend essentially the entire length of said opposite sides.

19. The lift of claim 1 wherein said enclosures are tubular, said enclosures are perforated, said enclosures are secured to said lift at a vertical height below the center of gravity of said lift, said enclosures are elongated and extend essentially the entire length of said opposite sides, said bladders are operatively connected to a common valve whereby both bladders can be inflated or deflated together, said enclosures have a volume from about 4 to about 30 cubic feet.

20. The lift of claim 1 wherein said enclosures are tubular and have opposite open ends.

* * * * *